US006232374B1

(12) United States Patent
Liu et al.

(10) Patent No.: US 6,232,374 B1
(45) Date of Patent: May 15, 2001

(54) SPANDEX WITH LOW TACKINESS AND PROCESS FOR MAKING SAME

(75) Inventors: Hong Liu; Robert Lee Lock, both of Waynesboro, VA (US); Bryan Benedict Sauer, Boothwyn, PA (US); Iftekhar A. Karimi, Gujarat (IN)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/355,233

(22) PCT Filed: Jan. 27, 1998

(86) PCT No.: PCT/US98/01673

§ 371 Date: Jul. 26, 1999

§ 102(e) Date: Jul. 26, 1999

(87) PCT Pub. No.: WO98/33962

PCT Pub. Date: Aug. 6, 1998

Related U.S. Application Data

(60) Provisional application No. 60/036,774, filed on Jan. 31, 1997.

(51) Int. Cl.[7] ..... C08K 5/21

(52) U.S. Cl. ..... 524/21 D; 524/211; 524/212

(58) Field of Search ..... 524/210, 211, 524/212

(56) References Cited

U.S. PATENT DOCUMENTS

| | | | |
|---|---|---|---|
| 3,382,202 | 5/1968 | Forrester et al. | 260/32.6 |
| 4,296,174 | 10/1981 | Hanzel et al. | 428/389 |
| 5,283,311 | 2/1994 | Narayan et al. | 528/49 |

FOREIGN PATENT DOCUMENTS

| | | | |
|---|---|---|---|
| 0 046 073 | 2/1982 | (EP) | D01F/6/70 |
| 0 343 985 | 11/1989 | (EP) | D01F/6/78 |
| 1339813 | 11/1971 | (GB) | C08G/41/00 |
| 1390324 | 3/1973 | (GB) | C08K/5/16 |
| 56-107010 | 8/1981 | (JP) | D01F/6/70 |
| 1-298259 | 12/1989 | (JP) | D04H/1/42 |
| 3-59112 | 3/1991 | (JP) | D01F/6/70 |
| 5-200692 | 8/1993 | (JP) | B26D/1/08 |
| 6-173112 | 6/1994 | (JP) | D01F/6/70 |
| 8-27375 | 1/1996 | (JP) | C08L/75/04 |
| WO 84 03292 | 8/1994 | (WO) | C08L/59/02 |

OTHER PUBLICATIONS

Patent Abstracts of Japan, vol. 096, No. 009, Sep. 30, 1996, & JP 08 113861 A (Kuraray Co. Ltd, May 7, 1996.

Database WPI, Section Ch, Week 9349, Derwent Publications Ltd., London, GB; AN 93–392811 XP002065453 & JP 05 295 177 A (Japan Synthetic Rubber Co. Ltd.).

*Primary Examiner*—Edward J. Cain
(74) *Attorney, Agent, or Firm*—George A. Frank

(57) ABSTRACT

Spandex containing certain anti-tack additives and having good dry-spinning continuity, and the process for making such spandex are provided.

10 Claims, No Drawings

SPANDEX WITH LOW TACKINESS AND PROCESS FOR MAKING SAME

CROSS-REFERENCE TO RELATED APPLICATIONS

This application claims the benefit of provisional application 60/036,774, filed Jan. 31, 1997.

BACKGROUND OF THE INVENTION

1. Field of the Invention

This invention relates to spandex having low tackiness and, more particularly, to spandex having dispersed therein effective amounts of an anti-tack additive.

2. Description of the Background Art

Spandex is known to be tacky. This is especially important in wound packages of dry-spun spandex, where the pressure can be very high due to "package relaxation", which is the recovery of the filament from the stretch it experiences during spinning. The high pressure can make it especially difficult to remove and use filament near the core of the package, where conditions are most extreme. Time and temperature contribute to tackiness, so that wound packages of spandex that have been stored, for example for months, experience significantly more core waste than freshly spun and wound packages. Reducing the tackiness and the resulting waste would improve the economics of spandex filament production. Steps taken to reduce tack, however, should not interfere with the continuity of the dry-spinning process by which spandex is made.

U.S. Pat. No. 4,296,174 discloses the incorporation of metal salts of fatty acids such as calcium stearate into dry-spun spandex to reduce the tackiness of the spandex. However, such additives are problematic in the dry-spinning process, creating deposits within the spinneret capillaries and plugging filters in the polymer solution lines. These effects are detrimental to spinning continuity, i.e. when the capillaries or filters become plugged, the continuous filament production is interrupted and the process must be stopped to clean out the plugging deposits or replace the plugged parts with clean ones. An anti-tack additive with a combination of good dry-spinning processibility and anti-tack characteristics is still desired.

Japanese Patent Application Publication Number 1-298259 ("JP '259") discloses a method for producing thermoplastic polyurethane elastic nonwoven fabric by melt-extruding and melt-blowing thermoplastic polyurethane which has been blended with 0.1–2.0 wt % of a compound represented by the formula:

$$(C_nH_{2n+1})_mX$$

wherein n is 15 to 35; m is 1 to 3; and X is a fatty acid ester having 5 or less carbons, a fatty amide having 5 or less carbons, or a fatty acid ester having 5 or less carbons that includes a calcium salt. In this method, the thermoplastic resin is melt-spun and simultaneously powerfully impacted by a high-temperature, high-speed gas discharged from adjoining gas jets which blasts apart the melt-spun fibers into ultrafine fibers which are then collected on a moving plate thereby giving a nonwoven sheet. The sheet can be unrolled after having been rolled up. In the Description of the Prior Art, JP '259 teaches the undesirability of polyurethane elastic fiber production by dry spinning, as disclosed in Japanese Patent Application Publication No. 52-81,177. An anti-tack additive for dry-spun polyurethane fiber is still desired.

U.S. Pat. No. 3,382,202 discloses an additive system to impart substantially non-blocking and non-tacky characteristics to formed polyurethane structures. The additive system consists essentially of (1) about 0.5 to 4.0 parts of certain amides and bis-amides derived from fatty acids, including ethylene bis-stearamide and stearamide, and (2) about 1 to 15 parts of a finely divided inert particulate solid such as diatomaceous earth, silica, talc, feldspar, mica, carbon black, calcium bicarbonate, or sodium bicarbonate. An anti-tack additive that does not require a second inert component is still desired.

SUMMARY OF THE INVENTION

The spandex of the present invention contains 0.1–5.0% by weight of the spandex of an anti-tack additive dispersed in the spandex wherein the additive is a compound of formula (I) or mixtures thereof:

$$R^1—Z—R^2 \quad (I)$$

wherein each of $R^1$ and $R^2$ is independently selected from the group consisting of alkyl having 14 to 22 carbon atoms and alkenyl having 14 to 22 carbon atoms, and Z is selected from the group consisting of

—C(O)—NH—$R^3$—NH—C(O)—,

—NH—C(O)—NH—$R^4$—NH—C(O)—NH—, and

—NH—C(O)—NH—, wherein $R^3$ is alkylene having 2 to 6 carbon atoms, and $R^4$ contains an aromatic or a cycloaliphatic group and has 6 to 18 carbon atoms, each of the nitrogen atoms being bonded to a ring carbon in the $R^4$ moiety.

The process of the present invention for making spandex comprises the steps of:

preparing a polyurethane solution;

mixing into the solution 0.1–5.0% by weight of the spandex of an anti-tack additive of formula (I) or mixtures thereof; and dry-spinning the solution to form spandex.

The spandex supply package of the present invention comprises a cylindrical core and spandex wound up on said core, wherein the spandex contains 0.1–5.0% by weight of the spandex of an anti-tack additive of formula (I) or mixtures thereof.

DETAILED DESCRIPTION OF THE INVENTION

The following abbreviations are used herein:

EBS Ethylene bis-stearamide (N,N'-1,2-ethanediylbis-octadecanamide)

MDI 1,1'-Methylenebis(4-isocyanatobenzene)

PICM Bis (4-isocyanatocyclohexyl)methane

EDA Ethylenediamine

MPMD 2-Methyl-1,5-pentanediamine

DEA Diethylamine

As used herein, "spandex" means a dry-spun, manufactured fiber in which the fiber-forming substance is a long chain synthetic elastomer comprised of at least 85% by weight of a segmented polyurethane. Polyurethaneureas are a sub-class of such polyurethanes. Such spandex can be typically wound up on a cylindrical core, or tube, to form a supply package.

The polymers used to make the spandex of this invention can be generally prepared by capping a macromolecular glycol with a diisocyanate, dissolving the resulting capped glycol in a suitable solvent, and chain extending the capped glycol with a diamine, a diol or an aminoalcohol. Small amounts of monofunctional chain terminators such as dialkylamines can be added to control the molecular weight of the polymer.

Any organic diisocyanate can be used for the purposes of this invention, such as MDI, 2,4-tolylene diisocyanate, PICM, hexamethylene diisocyanate, 3,3,5-trimethyl-5-methylenecyclohexyl diisocyanate (isophorone diisocyanate), and the like. MDI is referred.

The macromolecular glycol can be selected from one or more of several types of such glycols. Polyether glycols suitable for use in the present invention include those derived from tetramethylene glycol, 3-methyl-1,5-pentane diol, tetrahydrofuran, 3-methyltetrahydrofuran, and the like, and copolymers thereof. Glycol-terminated polyesters which can be used in the conjunction with the present invention include the reaction products of ethylene glycol, tetramethylene glycol (butanediol), and/or 2,2-dimethyl-1,3-propane diol and the like with diacids such as adipic acid, succinic acid, dodecanedioic acid, and the like. Copolymers are also contemplated. Also contemplated as glycols for use in the present invention are polyetheresters comprised of elements of the above polyethers and polyesters, and diol-terminated polycarbonates such as poly(pentane-1,5-carbonate) diol, poly(hexane-1,6-carbonate) diol, and the like.

Completion of the formation of the polymer can be accomplished by dissolving the capped glycol in a suitable solvent and chain extending with diols or diamines to form polyurethanes or the sub-class known as polyurethaneureas, respectively. Solvents suitable include dimethylacetamide (DMAc), N-methylpyrrolidone, and dimethylformamide. DMAc is preferred. Suitable diol chain extenders include ethylene glycol, tetramethylene glycol, and the like. Diamines that can be used with the present invention include EDA, 1,3 -cyclohexane diamine, 1,4-cyclohexane diamine, 1,3-propylene diamine, 2-methylpentamethylene diamine (MPMD), 1,2-propylene diamine, and the like, and mixtures thereof. Diamine chain extenders and the resulting polyurethaneureas are preferred. A small amount of a monoamine such as DEA can be mixed into the chain extender and reacted with the capped glycol in order to control the molecular weight of the final polyurethaneurea or polyurethane.

Following the preparation of the polyurethane in solution, either by forming the polyurethane in solution or by dissolving polyurethane in a suitable solvent, the anti-tack additive can be mixed into the solution. The anti-tack additive is a compound of formula (I) or mixtures thereof:

$$R^1—Z—R^2 \quad (I)$$

wherein each of $R^1$ $R^2$ is independently selected from the group consisting of alkyl having 14 to 22 carbon atoms and alkenyl having 14 to 22 carbon atoms, and Z is selected from the group consisting of

—C(O)—NH—$R^3$—NH—C(O)—,

—NH—C(O)—NH—$R^4$—NH—C(O)—NH—, and

—NH—C(O)—NH—, wherein $R^3$ is alkylene having 2 to 6 carbon atoms, and $R^4$ contains an aromatic or a cycloaliphatic group and has 6 to 18 carbon atoms, each of the nitrogen atoms being bonded to a ring carbon in the $R^4$ moiety. When $R^1$=$R^2$ and is substantially a linear, unsaturated $C_{18}H_{35}$ moiety and Z is —C(O)—NH—$CH_2CH_2$—NH—C(O)—, the additive is ethylene bis-oleylamide, which is preferred; when $R^1$=$R^2$=$C_{18}H_{37}$, the anti-tack agent is ethylene bis-stearamide, also referred.

The solution having the anti-tack additive dispersed therein is dry-spun to form the spandex of the invention. Dry-spinning is the process of forcing a polymer solution through spinneret orifices into a shaft to form a filament. Heated inert gas is passed through the chamber, evaporating the solvent from the filament as the filament passes through the shaft. The resulting spandex can then be wound on a cylindrical core to form a spandex supply package.

The anti-tack additive of this invention is present in the spandex in an amount of 0.1–5.0% by weight of the spandex to reduce tack in dry-spun spandex while surprisingly also providing improved dry-spinning continuity compared to other anti-tack additives.

In addition to the anti-tack additive, spandex of the present invention can contain conventional additives that are added for specific purposes, such as antioxidants, thermal stabilizers, UV stabilizers, pigments and delustrants (for example titanium dioxide), dyes and dye enhancers, lubricating agents (for example silicone oil), additives to enhance resistance to chlorine degradation (for example zinc oxide; magnesium oxide and mixtures of huntite and hydromagnesite), and the like, so long as such additives do not produce antagonistic effects with the spandex elastomer or anti-tack additive of this invention. Some of the conventional additives, such as titanium dioxide, exhibit small effects on over-end take-off tension (OETOT) measurements, the parameter used to judge tackiness of spandex (as described below in the Examples), but none of them has an appreciable effect on the OETOT measurements and are not added to the spandex in amounts so as to reduce tackiness.

The spandex can be of any decitex. Fine decitex filaments (below about 132 decitex and especially below about 44 decitex) are particularly susceptible to process disruptions due to their low diameter and the tenuous, low viscosity nature of the hot spinning solution as it exits from the spinneret orifice. Under such circumstances, the dry-spinning continuity is readily affected by filter blinding and spinneret deposits in the small-diameter spinneret holes that are used. Therefore, the present invention is particularly advantageous in the manufacture of fine decitex spandex.

Because the spandex of the present invention can be made with excellent dry-spinning continuity, relatively high levels of the anti-tack additive can be used. The useful amount of the anti-tack additive in the present spandex is in the range of 0.1% to 5.0%, preferably 0.4% to 2.0%, expressed as a weight percent based on the weight of the fiber. Below 0.1 wt %, there is little effect on the tackiness of the spandex, and above 5.0 wt %, the mechanical properties of the spandex are adversely affected.

A metal ion is not necessary to give the observed advantages, and in fact it is preferred that metal ions not be included as part of the additive. This will be apparent from the examples comparing the additives of this invention with metal stearates known in the art.

EXAMPLES

The amounts of the additives are given as weight percents based on total fiber weight.

Polymer for the dry-spun spandex in Examples 1, 2 and 3 was made by capping a 3550 molecular weight 87.5/12.5 (mole ratio) copolyether of tetrahydrofuran and 3-methyltetrahydrofuran with MDI at a capping ratio (the mole ratio of diisocyanate to polymeric glycol) of about 1.85. The resulting capped glycol was chain extended in DMAc with EDA and terminated with DEA. The polymer solution was then mixed with a slurry of additives in DMAc to form a "base solution". The slurry was such that in addition to any of the anti-tack additives contemplated by the present invention, the dry-spun fiber contained 1.5 wt % CYANOX® 1790 antioxidant [2,4,6-tris(2,6-dimethyl-4-t-butyl-3-hydroxybenzyl)isocyanurate Cytec Industries], West Patterson, N.J.], 0.4 wt % CYASORB® UV stabilizer [2,4-di(2',4'-dimethylphenyl)-6-(2"-hydroxy-4"-n-octyloxyophenyl)-1,3,5-triazine, Cytec Industries], 0.5 wt % METHACROL® 2462B UV stabilizer (a polymer of PICM and N-t-butyldiethanolamine, a registered trademark of E. I. du Pont de Nemours and Company, Wilmington, Del.), and 0.3 wt % silicone oil lubricant which was substantially as described in U.S. Pat. No. 3,296,063. An anti-tack slurry was mixed into the base solution to form a spinning solution which was dry-spun to produce the spandex. A 4% by weight of a finish (94 wt % polydimethylsiloxane and 6 wt % magnesium stearate, average particle size, 3 microns) was applied by a conventional finish roll to the 132 decitex spandex before it was wound onto 83 mm (outer diameter) tubes to form 680 g (fiber weight) packages with a final outer diameter of 142 mm. The stretch applied to the spandex during windup was in the range of about 17% to 18%.

Polymer for the dry-spun spandex in Examples 4 and 5 was made by capping an 1800 molecular weight polytetramethyleneether glycol with MDI at a capping ratio of about 1.7. The resulting capped glycol was chain extended in DMAc solvent with a mixture of EDA and MPMD (90/10 mole ratio) and terminated with DEA. The polymer solution was mixed with a slurry to form a base solution. The additive slurry was such that in addition to any of the anti-tack additives contemplated by the present invention, the dry-spun fiber contained 1.5 wt % CYANOX® 1790 antioxidant, 2.0 wt % METHACROL® 2138F UV stabilizer (a copolymer of diisopropylaminoethyl methacrylate and n-decyl methacrylate in a 75/25 ratio by weight, E. I. du Pont de Nemours and Company, Wilmington, Del.), and 0.6 wt % silicone oil lubricant substantially as disclosed in U.S. Pat. No. 3,296,063. An anti-tack slurry was prepared and mixed into the base solution to form a spinning solution which was dry-spun to produce the spandex. A 4.5% by weight of a finish comprising 94 wt % of the same silicone oil and 4 wt % magnesium stearate (average particle size 5 microns) was applied by a conventional finish roll to the 44 decitex spandex before it was wound onto 83 mm (outer diameter) tubes to form 410 g (fiber weight) packages having a final outer diameter of 150 mm. The stretch applied to the spandex during winding was in the range of about 25% to 29%.

Unless otherwise noted, the additive slurries were milled in a 1.5-liter capacity Premier Mill (Premier Mill Corp., Reading, Pa.) model HM1.5VSD, operated at 75% loading of 0.8 mm zirconia beads. The shaft spacer tip velocity was about 60 meters per minute and the slurry flow rate was 40 g/min. The slurries were generally milled in one pass. The slurry fluid in each case was DMAc. In some instances, in order to optimize the viscosity of the slurry, the same polyurethaneurea was added as that into which the additive was to be mixed. The slurry can be added into the polymer stream by itself or in combination with other, standard, additives or it can be added just prior to the spinning operation provided that there is sufficient mixing.

In each of the Examples, the controls are the samples with no further additive beyond those mixed into the base solution. A control was prepared and dry-spun with each set of test samples.

Test Method

Over-end take-off tension (OETOT) was determined in accordance with the procedures disclosed in Hanzel et al, U.S. Pat. No. 4,296,174, column 4, lines 20–45, with reference to FIG. 6 of the patent. In this technique, measurement is made of the average tension (i.e., average tensile load) required to remove a 183 m length of sample of spandex yarn from a tubular supply package of the yarn at a delivery rate of 45.7 meters per minute. In the examples below, measurements were made at the surface, center, and core of the package, that is, after a few grams of fiber have been removed to get to the intended winding pattern ("surface"), after an estimated one-half of the package has been removed ("center") and after all but about 125 grams have been removed from the package ("core"). The OETOT is reported in grams after oven-aging at 57° C. for 16 hr.; testing was done at least 24 hours after oven-aging. This test provides results which approximate those after about 6 months storage.

Additionally, in each case, the spandex of this invention was tested by conventional methods and found to have satisfactory mechanical properties.

Example 1

The anti-tack additive was prepared by reacting MDI or PICM with an unsaturated or saturated 18-carbon monoamine. The unsaturated amine was ADOGEN® 172-D (a mixture of $C_{14}$ to $C_{18}$ amines comprising 75% $C_{18}$ amine and being 80% unsaturated, Witco Chemical). The saturated amine was a technical grade 18-carbon monoamine (87% $C_{18}$ saturated amine, Aldrich Chemical Co. Milwaukee, Wis.).

In Table 1, the reaction product of unsaturated $C_{18}$ amine with MDI is designated "I", the product of saturated $C_{18}$ amine with MDI is designated "II", and the product of saturated $C_{18}$ amine with PICM is designated "III". The OETOT is reported in grams after oven-aging, and the core OETOT of the spandex of this invention is reported as a percent of the core OETOT of the control, which had no anti-tack additive. Low OETOT compared to the control is desirable because it indicates that less tension (i.e. a smaller tensile load) is needed to unwind the spandex indicating that the spandex is less tacky.

The residual DMAc in the dry-spun spandex was in the range of 0.14 to 0.20 weight percent.

TABLE 1

| TEST | ANTI-TACK ADDITIVE | OETOT (g) OUTSIDE | CENTER | CORE | % OF CONTROL OETOT |
|---|---|---|---|---|---|
| A1 | None (control) | 0.203 | 0.573 | 1.762 | — |
| B | 0.2% I | 0.044 | 0.596 | 0.694 | 39% |
| C | 0.5% I | 0.074 | 0.123 | 0.453 | 26% |
| D | 1.0% I | 0.094 | 0.116 | 0.466 | 26% |
| A2 | None (control) | 0.171 | 1.208 | 2.259 | — |
| E | 0.5% II | 0.050 | 0.992 | 1.858 | 82% |
| F | 0.5% III | 0.044 | 0.759 | 1.630 | 72% |

Each of the spandex samples of this invention showed an appreciable improvement in OETOT compared to the control spandex.

Example 2

The anti-tack additive in this Example was EBS (Witco Chemical, EBS-Powdered Metal Ultra Fine). The EBS slurry (80 parts by weight DMAc, 7 parts of the same polyurethaneurea that was to be spun, and 13 parts EBS) was milled in one pass through the mill.

The residual DMAc in the spandex was in the range of 0.23 to 0.29 weight percent.

TABLE 2

| TEST | ANTI-TACK ADDITIVE | OETOT (g) OUTSIDE | CENTER | CORE | % OF CONTROL OETOT |
|---|---|---|---|---|---|
| A3 | None (control) | 0.154 | 0.999 | 1.818 | — |
| G | 0.2% EBS | 0.117 | 0.843 | 1.141 | 63% |
| H | 0.5% EBS | 0.060 | 0.779 | 0.975 | 54% |
| I | 1.0% EBS | 0.046 | 0.169 | 0.333 | 18% |
| J | 2.0% EBS | 0.042 | 0.073 | 0.064 | 4% |

EBS showed excellent tack reduction, even in the absence of finely divided inert particles.

Example 3

Dioctadecyl urea (Aldrich Chemical Co.) was the anti-tack additive in this Example. The residual DMAc was in the range of 0.14 to 0.20 weight percent, based on the dry-spun spandex.

TABLE 3

| TEST | ANTI-TACK ADDITIVE | OETOT (g) OUTSIDE | CENTER | CORE | % OF CONTROL OETOT |
|---|---|---|---|---|---|
| A4 | None (control) | 0.203 | 0.573 | 1.762 | — |
| K | 0.5% N,N'-dioctadecyl urea | 0.099 | 1.042 | 1.386 | 79% |

Dioctadecyl urea was effective for reducing tack in dry-spun spandex.

Example 4

This example compares EBS with metal stearates with regard to their effect on spandex tackiness. The EBS slurry was prepared as described in Example 2. A calcium stearate slurry comprising 19% calcium stearate ("CaSt", obtained from Witco Chemical as "FP" grade) and 71% silicone oil (based on total weight of the slurry, the silicone oil being substantially as disclosed in U.S. Pat. No. 3,296,063) was prepared in a vertical 600-liter in-line homogenizer (Model 6002, Silverson Machines, East Longmeadow, Mass.).

Magnesium stearate ("MgSt") (median particle size 4.3 microns, Mallinckrodt Chemical Co.) was micronized to a particle size in the range of 0.2 to 9 microns. Micronizing breaks up the larger aggregates of magnesium stearate, thus shifting the distribution toward smaller particles. A slurry of 65 parts by weight DMAc, 20 parts polyurethaneurea (the same as what was to be spun), and 15 parts magnesium stearate was prepared by stirring the magnesium stearate into the DMAc and slowly mixing in the polyurethaneurea. After the polymer had dissolved, the slurry was passed twice through the Premier Mill at a rate of 50 g/min, using an 85% loading of 0.8 mm–1.0 mm zirconium silicate beads and a shaft spacer tip velocity of 60 meters per minute. The temperature was kept below 50° C. to prevent the magnesium stearate from softening. After milling, the slurry was passed through a 40 micron absolute wire mesh filter. The median particle size of the resulting magnesium stearate was about 2 microns.

After dry-spinning, the residual DMAc in the spandex was in the range of 0.4 to 0.6 percent, based on weight of fiber.

TABLE 4

| TEST | ANTI-TACK ADDITIVE | OETOT (g) OUTSIDE | CENTER | CORE | % OF CONTROL OETOT |
|---|---|---|---|---|---|
| A5 | None (control) | 0.099 | 0.443 | 0.841 | — |
| L | 0.5% EBS | 0.037 | 0.164 | 0.344 | 41% |
| M | 0.6% CaSt | 0.033 | 0.233 | 0.366 | 44% |
| N | 0.6% MgSt | 0.059 | 0.054 | 0.367 | 44% |

EBS was as effective in reducing tack as calcium stearate and micronized magnesium stearate at these levels.

Example 5

This Example illustrates the effect on the tack of dry-spun spandex of additives not of this invention. Stearamide was technical grade (Acros Organics, division of Fisher Scientific, Pittsburgh, Pa.). "IV" is the alkylene bis (alkylurea) reaction product of octadecyl isocyanate (technical grade, Aldrich) with EDA.

In the spandex, the residual DMAc was in the range of 0.4 to 0.6 weight percent, based on fiber.

TABLE 1

| TEST | ANTI-TACK ADDITIVE | OUTSIDE | CENTER | CORE | % OF CONTROL OETOT |
|---|---|---|---|---|---|
| A6 | None (control) | 0.09 | 0.333 | 0.582 | — |
| O | 1% stearamide | 0.118 | 0.497 | 0.788 | 135% |
| A7 | None (control) | 0.093 | 0.300 | 0.575 | — |
| P | 0.5% IV | 0.059 | 0.229 | 0.640 | 111% |

Neither the fatty acid amide nor the acyclic aliphatic bisurea was effective at reducing tack in dry-spun spandex.

Example 6

This Example illustrates the spinning continuity when dry-spinning polymer solutions containing an anti-tack additive of the present invention compared to the spinning continuity when dry-spinning polymer solutions containing an anti-tack additive not of this invention.

A test system was used which comprised (a) a solution pump, (b) a candle filter with a 30-micron Dynalloy sintered metal filter element (Memtec America, Deland, Fla.), (c) a metering pump, and (d) a spinneret plate having 0.03 cm (12 mil) diameter spinneret orifices. The polymer solution tested was the base solution as prepared for Examples 1, 2, and 3 with either 0.5 wt % EBS of this invention or 0.2 wt % micronized magnesium stearate. The polymer solution flux through the candle filter was 9.1 grams per square centimeter per hour. This test system becomes inoperable when the pressure drop across the filter has increased to about 335% of the starting (clean filter) pressure drop because at this point there is insufficient pressure at the metering pump for it to continue pumping to the spinnerets and broken filaments begin to appear. Pressure drop across the filter is used as a measure of process quality and spinning continuity.

In a first test, when the anti-tack additive was 0.5 wt % EBS, the test system was operated without changing the filter or spinneret plate for over six days. When the anti-tack additive was 0.2 wt % micronized magnesium stearate, poor processing required a change in the filter after about one day.

In a second test, with 0.2 wt % micronized magnesium stearate as the anti-tack additive, the rate of increase in the pressure drop across the filter was about 12.5% per hour over an 8-hour period, based on the startup (clean filter) pressure drop. In contrast, when 0.5 wt % E3S was used as the additive, no increase in pressure drop was observed across the filter over an 8-hour period.

As illustrated by these results, utilizing the anti-tack additives of this invention, unexpectedly good dry-spinning continuity is achieved in a process for making spandex in addition to obtaining low tack characteristics in the resulting wound packages of spandex. Furthermore, when using these additives, there is no need for finely divided inert particulate solids, such as diatomaceous earth, silica, talc, feldspar, mica, carbon black, calcium bicarbonate, or sodium bicarbonate, to obtain the advantageous results.

What is claimed is:

1. A spandex containing 0.1–5.0% by weight of the spandex of an anti-tack additive, wherein the additive is a compound of formula (I) or mixtures thereof:

$$R^1—Z—R^2 \quad (I)$$

wherein each of $R^1$ and $R^2$ is independently selected from the group consisting of alkyl having 14 to 22 carbon atoms and alkenyl having 14 to 22 carbon atoms, and Z is selected from the group consisting of

—C(O)—NH—$R^3$—NH—C(O)—,

—NH—C(O)—NH—$R^4$—NH—C(O)—NH—, and

—NH—C(O)—NH—, wherein $R^3$ is alkylene having 2 to 6 carbon atoms, and $R^4$ is an aromatic or a cycloaliphatic group and has 6 to 18 carbon atoms, each of the nitrogen atoms being bonded to a ring carbon in the $R^4$ moiety.

2. The spandex of claim 1, wherein the spandex comprises polyurethaneurea.

3. The spandex of claim 1 wherein the anti-tack additive is ethylene bis-stearamide or ethylene bis-oleylamide.

4. The spandex of claim 2 wherein said spandex is less than about 44 decitex.

5. The spandex of claim 1 wherein the glycol precursor portion of the spandex polyurethane is a copolymer of tetrahydrofuran and 3-methyltetrahydrofuran.

6. A spandex supply package comprising a cylindrical core and the spandex of claim 1 wound up on said core.

7. A process for making spandex containing an anti-tack additive comprising the steps of:

(a) preparing a polyurethane in solution;

(b) adding 0.1–5.0% by weight of the spandex of an anti-tack additive of formula (I) or mixtures thereof:

$$R^1—Z—R^2 \quad (I)$$

wherein each of $R^1$ and $R^2$ is independently selected from the group consisting of alkyl having 14 to 22 carbon atoms and alkenyl having 14 to 22 carbon atoms, and Z is selected from the group consisting of

—C(O)—NH—$R^3$—NH—C(O)—,

—NH—C(O)—NH—$R^4$—NH—C(O)—NH—, and

—NH—C(O)—NH—, wherein $R^3$ is alkylene having 2 to 6 carbon atoms, and $R^4$ is an aromatic or a cycloaliphatic group and has 6 to 18 carbon atoms, each of the nitrogen atoms being bonded to a ring carbon in the $R^4$ moiety; and (c) dry-spinning the solution to form the spandex.

8. The process of claim 7 wherein the polyurethane is a polyurethaneurea.

9. The process of claim 7 wherein the anti-tack additive is ethylene bis-stearamide or ethylene bis-oleylamide.

10. The process of claim 7 further comprising the step of:

(d) winding the spandex around a cylindrical core.

* * * * *